US008671951B2

(12) United States Patent
Ercelebi et al.

(10) Patent No.: US 8,671,951 B2
(45) Date of Patent: Mar. 18, 2014

(54) METHODS OF MANUFACTURING CIGARETTES AND FILTER SUBASSEMBLIES WITH SQUEEZABLE FLAVOR CAPSULE

(75) Inventors: Ahmet Ercelebi, Mechanicsville, VA (US); Martin T. Garthaffner, Chesterfield, VA (US); Dwight D. Williams, Powhatan, VA (US)

(73) Assignee: Philip Morris USA Inc., Richmond, VA (US)

( * ) Notice: Subject to any disclaimer, the term of this patent is extended or adjusted under 35 U.S.C. 154(b) by 674 days.

(21) Appl. No.: 12/748,234

(22) Filed: Mar. 26, 2010

(65) Prior Publication Data

US 2011/0232659 A1 Sep. 29, 2011

(51) Int. Cl.
*A24C 1/32* (2006.01)

(52) U.S. Cl.
USPC ..... 131/88; 493/47

(58) Field of Classification Search
USPC ..... 131/88, 94, 29, 61.1, 76, 335, 337; 493/39–50; 424/456, 463
See application file for complete search history.

(56) References Cited

U.S. PATENT DOCUMENTS

| | | | |
|---|---|---|---|
| 2,755,206 | A | 7/1956 | Statia, Sr. |
| 3,339,558 | A | 9/1967 | Waterbury |
| 3,366,121 | A | 1/1968 | Carty |
| 3,428,049 | A | 2/1969 | Leake et al. |
| 3,547,130 | A | 12/1970 | Harlow |
| 3,575,180 | A | 4/1971 | Carty |
| 3,599,646 | A | 8/1971 | Berger |
| 3,635,226 | A | 1/1972 | Horsewell et al. |
| 3,847,064 | A | 11/1974 | Berger |
| 3,916,914 | A | 11/1975 | Brooks et al. |
| 3,991,773 | A | 11/1976 | Walker |
| 4,064,791 | A | 12/1977 | Berger |
| 4,182,743 | A | 1/1980 | Rainer et al. |

(Continued)

FOREIGN PATENT DOCUMENTS

| | | | |
|---|---|---|---|
| DE | 1243072 | B | 6/1967 |
| EP | 0292949 | A | 11/1988 |

(Continued)

OTHER PUBLICATIONS

International Preliminary Report on Patentability Issued Oct. 2, 2012 for PCT/EP2011/001504.

(Continued)

*Primary Examiner* — Richard Crispino
*Assistant Examiner* — Yana Belyaev
(74) *Attorney, Agent, or Firm* — Buchanan Ingersoll & Rooney PC

(57) ABSTRACT

A cigarette filter subassembly is manufactured from a filter member having absorbent material encased within an outer cover. A plunger is passed axially through the absorbent material such that a pointed leading end of the plunger displaces the absorbent material radially outwardly against the cover to form a liner of compressed absorbent material along the cover's inside surface. An inner surface of the liner surrounds a hollow axial opening which is to receive absorbent members and capsules inserted axially therein. The capsules are adapted to be broken by a smoker to release an additive material which modifies characteristics of tobacco smoke. An outer cylindrical surface of the plunger optionally carries a transferable binder material that becomes smeared onto the inner surface of the liner to form thereon a coating which is impermeable to the additive material released from the capsule.

15 Claims, 4 Drawing Sheets

(56) References Cited

U.S. PATENT DOCUMENTS

| | | | | |
|---|---|---|---|---|
| 4,357,950 | A | 11/1982 | Berger | |
| 4,675,064 | A | 6/1987 | Berger | |
| 4,693,265 | A | 9/1987 | Norman | |
| 4,715,390 | A | 12/1987 | Nichols et al. | |
| 4,807,647 | A | 2/1989 | Hayes | |
| 4,862,905 | A | 9/1989 | Green, Jr. et al. | |
| 4,869,275 | A | 9/1989 | Berger | |
| 4,889,144 | A | 12/1989 | Tateno et al. | |
| 4,920,990 | A | 5/1990 | Lawrence et al. | |
| 5,109,876 | A | 5/1992 | Hayden et al. | |
| 5,186,185 | A | 2/1993 | Mashiko et al. | |
| 5,322,075 | A | 6/1994 | Deevi et al. | |
| 5,356,704 | A | 10/1994 | Phillips et al. | |
| 5,360,023 | A | 11/1994 | Blakley et al. | |
| 5,465,739 | A | 11/1995 | Perfetti et al. | |
| 5,499,636 | A | 3/1996 | Baggett, Jr. et al. | |
| 5,591,368 | A | 1/1997 | Fleischhauer et al. | |
| 5,662,126 | A | 9/1997 | Charlton et al. | |
| 5,666,976 | A | 9/1997 | Adams et al. | |
| 5,692,525 | A | 12/1997 | Counts et al. | |
| 5,692,526 | A | 12/1997 | Adams et al. | |
| 5,787,902 | A | 8/1998 | Shepherd et al. | |
| 5,915,387 | A | 6/1999 | Baggett, Jr. et al. | |
| 5,934,289 | A | 8/1999 | Watkins et al. | |
| 5,988,176 | A | 11/1999 | Baggett, Jr. et al. | |
| 6,026,820 | A | 2/2000 | Baggett, Jr. et al. | |
| 6,041,790 | A | 3/2000 | Smith et al. | |
| 6,053,176 | A | 4/2000 | Adams et al. | |
| 6,079,418 | A | 6/2000 | Russo | |
| 6,209,547 | B1 | 4/2001 | Koller et al. | |
| 6,595,218 | B1 | 7/2003 | Koller et al. | |
| 6,761,174 | B2 | 7/2004 | Jupe et al. | |
| 6,918,867 | B2 | 7/2005 | Scherbarth et al. | |
| 7,584,843 | B2 | 9/2009 | Kutsch et al. | |
| 2004/0074507 | A1 | 4/2004 | MacAdam et al. | |
| 2004/0118419 | A1 | 6/2004 | Hancock et al. | |
| 2004/0237980 | A1 | 12/2004 | Holmes | |
| 2004/0261807 | A1* | 12/2004 | Dube et al. | 131/337 |
| 2005/0066981 | A1 | 3/2005 | Crooks et al. | |
| 2005/0066984 | A1 | 3/2005 | Crooks et al. | |
| 2005/0070409 | A1 | 3/2005 | Deal | |
| 2006/0052226 | A1 | 3/2006 | Rinke et al. | |
| 2007/0012327 | A1* | 1/2007 | Karles et al. | 131/337 |
| 2009/0314300 | A1* | 12/2009 | Cooper | 131/255 |
| 2011/0190105 | A1 | 8/2011 | Fallon | |

FOREIGN PATENT DOCUMENTS

| | | | |
|---|---|---|---|
| EP | 0452906 | A | 10/1991 |
| EP | 0491952 | A | 7/1992 |
| EP | 0276021 | A | 7/1998 |
| FR | 2122014 | A | 8/1972 |
| JP | 2000-14377 | A | 1/2000 |
| NL | 1017166 | C2 | 7/2002 |
| WO | 03/009711 | A1 | 2/2003 |

OTHER PUBLICATIONS

International Search Report and Written Opinion mailed Jul. 28, 2011 for PCT/EP2011/001504.

International Preliminary Report on Patentability dated Nov. 6, 2007 for PCT/IB2006/001840.

* cited by examiner

METHODS OF MANUFACTURING CIGARETTES AND FILTER SUBASSEMBLIES WITH SQUEEZABLE FLAVOR CAPSULE

FIELD OF THE INVENTION

The present disclosure relates to cigarettes and filter subassemblies for use with cigarettes as well as to methods of manufacturing cigarettes and cigarette filters.

BACKGROUND

Disclosed in U.S. Patent Publication No. 2007/0012327, incorporated herein by reference, is a cigarette filter subassembly which comprises a first cylindrical cellulose acetate absorbent member defining a first end surface, with the first end surface of the first absorbent member forming a first end of the cigarette filter subassembly. A second cylindrical cellulose acetate absorbent member defines a second end surface, with the second end surface of the second absorbent member forming a second end of the cigarette filter subassembly. At least one capsule is provided between the first absorbent member and the second absorbent member with the capsule(s) containing a releasable additive material for modifying characteristics of tobacco smoke during smoking of the cigarette. The capsule(s) releases at least a portion of the releasable material when subjected to external force. The cigarette filter subassembly has an outer cover extending substantially from the first end of the cigarette filter subassembly to the second end of the cigarette filter subassembly and encloses the capsule(s). The outer cover is formed of a material which is substantially impermeable to the releasable material of the capsule(s).

A method for manufacturing those cigarette filter subassemblies comprises the steps of: providing a series of absorbent members; providing at least one capsule between adjacent absorbent members with the capsule(s) containing a releasable material for modifying characteristics of tobacco smoke during smoking of the cigarette. The capsule(s) releases at least a portion of the releasable material when subjected to external force. The method further comprises the step of providing an outer cover about the series of absorbent members and the capsule(s). The outer cover is formed of a material which is substantially impermeable to the releasable material of the capsule(s). An annular layer of cellulose acetate is then formed about the outer cover of the cigarette filter subassembly.

There is an interest in an improved method for making the cigarette filter subassembly.

SUMMARY

An embodiment of a method of manufacturing cigarette filter subassemblies, each defining a longitudinal center axis, comprises the steps of: providing a filter member comprising absorbent material surrounded by a cover; passing a plunger axially through the absorbent material such that a generally pointed leading end of the plunger displaces the absorbent material radially outwardly against the cover, wherein the displaced absorbent material forms a liner of absorbent material along an inside surface of the cover and defines a hollow axial opening within the absorbent material; axially inserting at least one absorbent member and at least one capsule into the hollow space, the capsule containing a releasable material for modifying characteristics of tobacco smoke during smoking.

Preferably, prior to the axial insertion step, a coating is provided on an inner surface of the liner which is substantially impermeable to the releasable material in the at least one capsule.

The coating on the liner is preferably formed by applying to an outer cylindrical surface of the plunger a binder material which is transferred to the inner surface of the liner as the liner is being formed.

BRIEF DESCRIPTION OF THE DRAWING FIGURES

DETAILED DESCRIPTION

Figure 1:
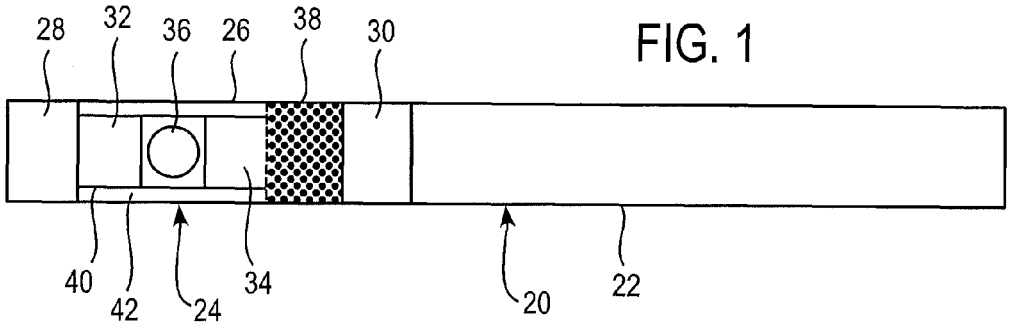
FIG. 1 is a perspective view of a cigarette filter subassembly with an outer cover thereof broken away, according to an embodiment.

A method of making a cigarette filter substantially having a releasable additive material, such as a flavor component, in a tobacco product, such as a cigarette, is described hereafter. Improved delivery through controlled release of the additive material to cigarettes may be achieved through the use of one or more capsules, which are preferably sealed or frangible capsules, containing the additive material. The filter subassembly is formed by passing a pointed plunger through the cellulose acetate absorbent material of a conventional filter to displace the absorbent material radially outwardly, whereby the absorbent material is compressed and forms a liner along the outer cover of the filter. The plunger is covered with a viscous binder material that is smeared onto an inner surface of the liner as the liner is being formed. Then, absorbent member(s) and capsule(s) are inserted axially into an opening formed by the liner. The capsule, when broken by a smoker, releases the additive material. The coating of binder material on the liner forms a coating which is impermeable to the released additive material, e.g., a liquid or vapor, to resist the outward migration of the additive material.

A. Cigarettes

A cigarette typically contains two sections, a tobacco-containing portion sometimes referred to as the tobacco or cigarette rod, and a filter portion which may be referred to as a filter tipping. Tipping paper typically surrounds the filter, which forms the mouth end of the cigarette. The tipping paper overlaps with the tobacco rod in order to hold the filter and tobacco rod together. The tobacco rod, or tobacco containing element of the cigarette, includes the paper wrapper in which the tobacco is wrapped and the adhesive holding the seams of the paper wrapper together. The tobacco rod has a first end which is integrally attached to the filter and a second end which is lit or heated for smoking the tobacco. When the tobacco rod is lit or heated for smoking, the smoke travels from the lit end downstream to the filter end of the tobacco rod and further downstream through the filter.

The filter can be used with traditional cigarettes and non-traditional cigarettes. Non-traditional cigarettes include, for example, cigarettes for electrical smoking systems as described in commonly-assigned U.S. Pat. Nos. 6,026,820; 5,988,176; 5,915,387; 5,692,526; 5,692,525; 5,666,976; and 5,499,636, the disclosures of which are incorporated by reference herein in their entireties.

An exemplary embodiment of a method of making cigarettes comprises providing a cut filler to a cigarette-making machine to form a tobacco portion (e.g., a tobacco column); placing a paper wrapper around the tobacco column to form a tobacco rod; and attaching a filter portion to the tobacco rod to form the cigarette.

The term "mainstream smoke" includes the mixture of gases and/or aerosols passing down a cigarette, such as a tobacco rod, and issuing from an end, such as through the filter end, i.e., the amount of smoke issuing or drawn from the mouth end of a cigarette during smoking of the cigarette. The mainstream smoke contains air that is drawn in through the heated region of the cigarette and through the paper wrapper.

"Smoking" of a cigarette is intended to mean the heating, combusting or otherwise causing a release of certain chemicals from tobacco. Generally, smoking of a cigarette involves lighting one end of the cigarette and drawing the smoke downstream through the mouth end of the cigarette, while the tobacco contained therein undergoes combustion, pyrolysis or distillation of volatiles. However, the cigarette may also be smoked by other ways. For example, the cigarette may be smoked by heating the cigarette using an electrical heater, as described, for example, in commonly-assigned U.S. Pat. Nos. 6,053,176; 5,934,289; 5,591,368 or 5,322,075, each of which is incorporated herein by reference in its entirety.

B. Tobacco

Examples of suitable types of tobacco materials that may be used include, but are not limited to, flue-cured tobacco, Burley tobacco, Maryland tobacco, Oriental tobacco, rare tobacco, specialty tobacco, blends thereof and the like. The tobacco material may be provided in any suitable form, including, but not limited to, tobacco lamina, processed tobacco materials, such as volume expanded or puffed tobacco, processed tobacco stems, such as cut-rolled or cut-puffed stems, reconstituted tobacco materials, blends thereof, and the like. Tobacco substitutes may also be used.

In traditional cigarette manufacture, the tobacco is normally used in the form of cut filler, i.e., in the form of shreds or strands cut into widths ranging from about 1/10 inch to about 1/20 inch or even about 1/40 inch. The lengths of the strands range from between about 0.25 inch to about 3.0 inches. The cigarettes may further comprise one or more flavors, or other suitable additives (e.g., burn additives, combustion modifying agents, coloring agents, binders, etc.).

C. Filters

The filter material of the filter may be any of the variety of fibrous materials suitable for use in tobacco smoke filter elements. Typical fibrous materials include cellulose acetate, polypropylene or paper. Preferably, the filter material will be cellulose acetate.

The filter of a cigarette may also include a sorbent such as sorbent particles. Preferably, the sorbent particles have a size of about 0.3 mm to about 0.85 mm or 20 to 50 mesh size to facilitate loading into cavities of cigarette filters so as to achieve a desirable filter pressure drop (resistance to draw). This applies to a situation where the sorbent fills a well defined cavity in the filter section. Sorbents can be used in other forms in cigarette filters, e.g., sorbent particles may be distributed in the filamentary tow and in that form may be used as different segment lengths in the filter to provide the desirable reduction in one or more mainstream gas phase constituents.

Various cigarette filter constructions may be used, in which one or more capsules may be incorporated. Exemplary filter structures that may be used include, but are not limited to, a mono filter, a dual filter, a triple filter, a single or multi cavity filter, a recessed filter, a free-flow filter, combinations thereof and the like. Mono filters typically contain cellulose acetate tow or cellulose paper materials. Pure mono cellulose filters or paper filters offer good tar and nicotine retention, and are highly degradable. Dual filters typically comprise a cellulose acetate mouth end and a pure cellulose or cellulose acetate segment. The length and pressure drop of the segments in a dual filter may be adjusted to provide optimal sorption, while maintaining acceptable draw resistance. Triple filters may include mouth side and smoking material or tobacco side segments, and a middle segment comprising paper. Cavity filters include at least two segments, e.g., acetate-acetate, acetate-paper or paper-paper, separated by at least one cavity. Recessed filters include an open cavity on the mouth side. The filters may also be ventilated and/or comprise additional sorbents, catalysts or other additives suitable for use in the cigarette filter.

A filter region of an exemplary embodiment of a cigarette may be constructed with an upstream sorbent and a downstream capsule. A sorbent, for example, activated carbon, can be located in a cavity at a distance from one or more capsules, which can be located in a second section or portion of a filter spaced from the sorbent. Such arrangement would allow for the filtration of the cigarette to be accomplished by the sorbent, and for the flavor to be disposed within the cigarette without the effectiveness of the flavor being affected by absorption or adsorption by the sorbent.

D. Sorbents

As used herein, the term "sorption" denotes filtration by adsorption and/or absorption. Sorption is intended to encompass interactions on the outer surface of the sorbent, as well as interactions within the pores and channels of the sorbent. In other words, a "sorbent" is a substance that may condense or hold molecules of other substances on its surface, and/or take up other substances, i.e., through penetration of the other substances into its inner structure, or into its pores.

As used herein, the term "sorbent" refers to an adsorbent, an absorbent, or a substance that may perform both of these functions.

As used herein, the term "remove" refers to adsorption and/or absorption of at least some portion of a constituent of mainstream tobacco smoke.

While any suitable material may be used as a sorbent, preferred embodiments include activated carbon sorbents or microporous materials. The sorbent may be any material which has the ability to absorb and/or adsorb gas constituents on the surface thereof or to assimilate such constituents into the body thereof. If desired, the sorbent can incorporate catalyst material therein. By way of example, sorbent materials may include, but are not limited to, carbons such as activated carbon, aluminas, silicates, molecular sieves, and zeolites and may be used alone or in combination. In a preferred embodiment, the sorbent material is activated carbon.

Microporous materials (i.e., microporous sorbents) such as, for example, an activated carbon can be used to filter out gas constituents from cigarette smoke. The microporous sorbent may have pores with widths or diameters of less than about 20 Å.

While microporous materials are useful for filtering cigarette smoke, microporous materials may also hinder a cigarette designer's ability to add volatile flavor components like menthol, for example. In particular, microporous sorbents tend to adsorb and/or absorb the flavor components during the time between cigarette manufacture and use by the consumer, thus reducing the effectiveness of the flavor components in the cigarette.

In addition to the reduction of the effectiveness of the flavor components due to the adsorption/absorption by the microporous sorbents, two additional problems are also encountered when the flavor component migrates to and is adsorbed/absorbed by the sorbent. First, the flavor component may occupy active sites in the sorbent; thereby reducing the sorbent's ability to remove targeted gas phase constituents from smoke. Second, because the flavor component is often strongly adsorbed/absorbed by the sorbent, the flavor component may not be sufficiently releasable. As such, separation between the microporous materials and the flavor components, or other additives is desired.

Another advantage of the controlled release of encapsulated volatile flavors in the filter is that encapsulated volatile additives are added to the smoke stream through the filter portion.

E. Additives

The term "additive" means any material or component which modifies the characteristics of a cigarette when the cigarette is smoked. Any appropriate additive material or combination of materials may be contained inside the one or more capsules to modify the characteristics of the cigarette. Such additive materials include flavors, neutralizing agents, and other smoke modifiers, such as chemical reagents like 3-aminopropylsilyl (APS) which interacts with smoke constituents. Additionally, the additive materials may also include diluents, solvents or processing aids that may or may not impact the sensorial attributes of the mainstream smoke but aid in processing of an additive and its encapsulation and presentation in a cigarette.

In a preferred embodiment, the additive materials may include one or more flavors, such as liquid or solid flavors and flavor formulations or flavor-containing materials. The term "flavor" or "tobacco flavor" may include any flavor compound or tobacco extract suitable for being releasably disposed in liquid form within one or more capsules such as one-piece capsules, two-part capsules, or macrocapsules to enhance the taste of mainstream smoke produced, for example, by a cigarette.

Suitable flavors or flavorings include, but are not limited to, menthol, mint, such as peppermint and spearmint, chocolate, licorice, citrus and other fruit flavors, gamma octalactone, vanillin, ethyl vanillin, breath freshener flavors, spice flavors such as cinnamon, methyl salicylate, linalool, bergamot oil, geranium oil, lemon oil, ginger oil, and tobacco flavor. Other suitable flavors may include flavor compounds selected from the group consisting of an acid, an alcohol, an ester, an aldehyde, a ketone, a pyrazine, combinations or blends thereof and the like.

In one embodiment, the additive material may serve as a chemical reagent for one or more constituents of mainstream smoke. Such an additive material may include, by way of example, a chemical additive which interacts with the one or more constituents in mainstream smoke. For example, see commonly assigned U.S. Pat. Nos. 6,209,547 and 6,595,218, which discuss reagents which can interact with and can remove gaseous constituents of a smoke stream, and are expressly incorporated herein by reference in their entireties.

F. Capsules

The capsules in the filter arrangement provide advantages particularly for cigarettes containing activated carbon. By placing the sealed capsules in the filter downstream from activated carbon in cigarettes containing activated carbon in the filter, adsorption of released additive material by the activated carbon and consequent deactivation of the carbon is substantially prevented. Thus, where the additive material is a flavor component, flavor adsorption by the activated carbon during storage of cigarettes and during smoking is substantially prevented.

By incorporating the additive material such as solid, vapor, or liquid in one or more capsules in a filter, loss of flavor to side stream smoke is substantially reduced and less or none of the flavor component is pyrolyzed during the smoking of the cigarette. In addition, by positioning the one or more capsules containing the additive material in the filter section, the activated carbon can maintain its ability to modify cigarette smoke, which includes removing volatile organic components, such as 1,3-butadiene, acrolein, isoprene, etc., from mainstream smoke.

The term "releasably disposed" as used herein refers to the containment and release of additive materials in capsules such that the additive materials are sufficiently contained to substantially avoid or minimize unwanted migration, such as, for example, during storage. This term also includes, but is not limited to, the additive materials in the capsule being mobile enough to be released from the capsule when, for example, the capsule is broken or opened by mechanical force. For example, the capsule may be broken by squeezing a portion of a cigarette filter containing the capsule, thus releasing the additive material from within the capsule.

The capsule may be formed in a variety of physical formations including singular part or multipart capsules, large capsules, small capsules, etc. One preferred capsule shape is spherical, as shown in the appended figures. Another preferred capsule shape is oval which defines a long or longitudinal axis, with the capsule arranged such that the long axis is generally parallel to the longitudinal center axis of the cigarette. These preferred embodiments may include liquid additives and the additives may be released similarly by mechanical action. The capsules may be present in the filter section of a cigarette in a dispersed arrangement if small macrocapsules are provided, or may be present in a plug or cavity within a filter for one more capsules, preferably a single generally spherical capsule. However, the capsule or capsules are preferably present downstream from any sorbents in a cigarette, such as activated carbon.

Single wall or multi-wall capsules may be used to tailor capsule stability, strength, rupture resistance, processing ease in filter making, etc. The capsules may be made of any suitable material, such as those used in capsules for drug delivery, liquid encapsulated capsules, or other encapsulated materials. By way of example, capsules typically utilized in the pharmaceutical industry may be used. Such capsules may be gelatin based, for example, or may be formed from a polymeric material, such as modified cellulose. One type of modified cellulose which may be used is hydroxypropylmethyl cellulose. Desirable burst strength of the capsules may be achieved by coating the capsules with a material that renders the capsule exterior more brittle, thereby facilitating rupturing of the capsule without the need for designing weak points in the capsule wall. This enables the capsule wall to be formed of a material which provides certain benefits, but which may be too flexible to promote rupturing by a user. In such a case, the coating of the capsule wall with a material that increases the brittleness of the capsule wall can provide the desired burst strength of the capsules.

G. Preferred Embodiments

Figure 2:
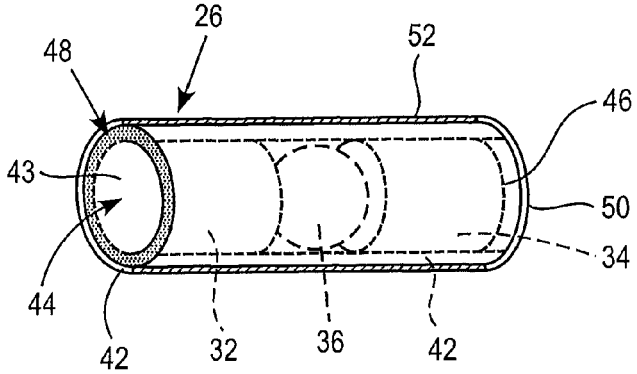
FIG. 2 is a longitudinal sectional view of a cigarette constructed in accordance with an embodiment.

With reference to FIG. 2, a cigarette 20 includes a tobacco rod 22 which is provided adjacent to a filter assembly 24. The filter assembly 24 includes a filter subassembly 26 having a first absorbent member 32 and a second absorbent member 34 spaced apart along a longitudinal center axis L of the subassembly, with a capsule 36 provided in a space formed between the first and second absorbent members 32, 34. A third absorbent member 28 is provided on a first side of the filter subassembly 26 and a fourth absorbent member 30 is provided on a second side of the filter subassembly 26. A quantity of activated carbon 38 is provided between the fourth absorbent member 30 and the second end of the filter subassembly 26. The fourth absorbent member 30 may also contain a quantity of activated carbon 38 wherein the sorbent articles are distributed in the filamentary tow.

With reference now to FIG. 1, showing the fitter subassembly 26 in more detail, the first absorbent member 32 is generally cylindrical in shape and defines a first end surface 44. The first end surface 44 of the first absorbent member 32 forms a first end 48 for the cigarette filter subassembly 26. The second absorbent member 34 is also generally cylindrical in shape and defines a second end surface 46. The second end surface 46 of the second absorbent member 34 forms a second end 50 of the cigarette filter subassembly 26. The first and second absorbent members 32, 34 are enclosed about their outer surface by a cover 52 in the form of a suitable conventional plug wrap.

The capsule 36 is of spherical shape and provided between the first absorbent member 32 and the second absorbent member 34. Alternatively, the capsule could be of oval shape with its long axis arranged parallel to the center longitudinal axis of the filter subassembly. The capsule 36 contains a releasable additive which could be a solid or fluid material, such as a liquid or vapor, for modifying characteristics of tobacco smoke during smoking of the cigarette 20. The capsule 36 releases at least a portion of the additive material when the capsule 36 is subjected to external force, such as by squeezing by the smoker.

In the preferred embodiment, the first and second absorbent members 32, 34 are comprised of cellulose acetate. Although in the preferred embodiment only a single capsule 36 is provided between the first and second absorbent members 32, 34, additional capsules 36 or a plurality of smaller capsules may be provided between the first and second absorbent members 32, 34.

The capsule 36 has a substantially continuous outer shell enclosing the additive material within the shell. The outer shell comprises a flexible wall that is coated with a material that increases the brittleness of the shell, thereby promoting rupturing of the material in response to the application of an external force.

An annular liner 42 of compressed cellulose acetate is provided about the absorbent members 32, 34 and the capsule 36. A plug wrap 52 is provided about the annular liner 42 of compressed cellulose acetate. An inner surface of the liner 42 is provided with a coating 43 of a binder material such as triacetin or other suitable materials to render the liner impermeable to the releasable liquids or vapors provided in the capsule.

Figure 3:
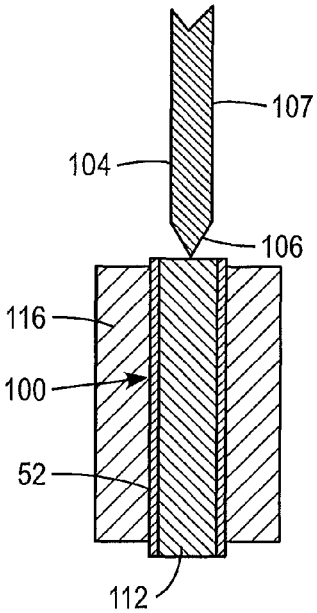
FIG. 3 is a cross sectional view through a filter structure showing a step involved in the manufacture of the cigarette filter subassembly of FIG. 1.
Figure 4:
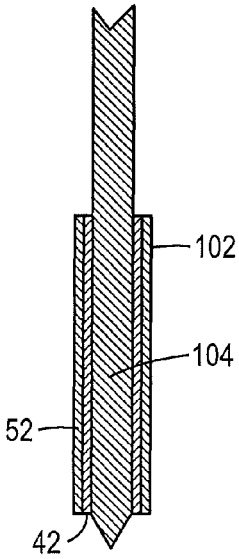
FIG. 4 depicts the filter structure of FIG. 3 after it has been pierced by a plunger.

In a preferred embodiment of a method for making the filter subassembly 26, there is provided a rod of filter material 100 (FIG. 3) comprised of an absorbent material 112 such as cellulose acetate surrounded by a cover 52, e.g., conventional plug wrap. The cellulose acetate is pierced in the axial direction of the filter by a plunger 104 (FIG. 4) having a convergent leading end 106, e.g., an end in the shape of a generally pointed cone. The outer diameter of a cylindrical surface of the plunger is less than the inner diameter of the cover 52, so the plunger displaces the cellulose acetate radially outwardly and compresses it between the cover and the cylindrical outer surface 107 of the plunger. As a result, there is formed the compressed liner 42 of cellulose acetate surrounding a hollow opening 114 extending longitudinally through the filter. The exterior of the filter can be gripped and supported in any suitable manner by a gripping structure 116 engaging the outer surface of the cover (shown only in FIG. 3). The filter can be disposed in any desired orientation during the piercing step, e.g., vertically or horizontally. The cellulose acetate material can be a relatively low-weight material to facilitate passage of the plunger.

The outer surface of the plunger 104 is coated with a viscous binding agent such as triacetin or other suitable materials, which becomes smeared onto the inner surface of the liner 42 as the plunger is advanced through the cellulose acetate absorbent material, in order to form the coating 43 thereon which renders the liner impermeable to whatever type of additive material is contained in the capsules. Thus, the cover 52 will be effectively isolated from the additive material by the coated compressed liner 42, 43.

Figure 5:
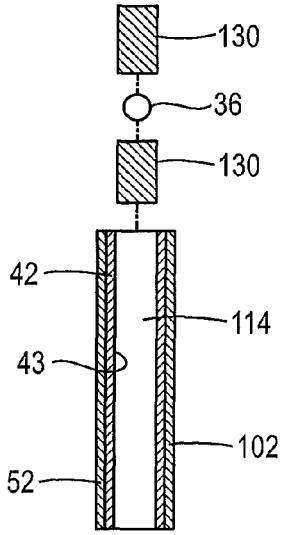
FIG. 5 is a view similar to FIG. 4 following the piercing step showing absorbent members and a capsule being inserted into the pierced filter member.

Once the hollow opening 114 has been formed in the absorbent material 112, cylindrical cellulose acetate members 130 and capsules 36 can be inserted alternatingly into the opening in an axial direction (FIG. 5) in any suitable manner. As that occurs, the hollowed-out filter can be situated in any desired orientation, e.g., vertically or horizontally.

Figure 6:
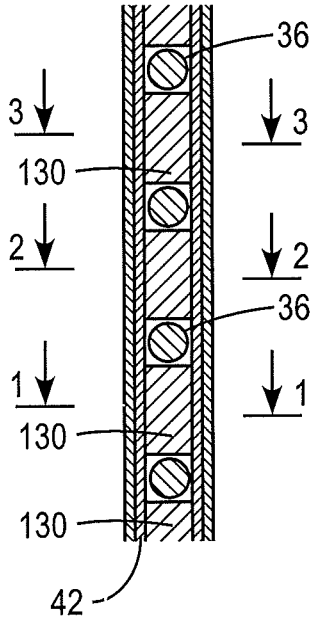
FIG. 6 is a longitudinal sectional view of a filter structure formed according to an embodiment.

Following the insertion of a series of the members 130 and capsules 36, as shown in FIG. 6, cuts can be made along cut lines 1-1, 2-2 and 3-3 through midpoints of the respective filter members 130 to form respective filter subassemblies 26 shown in FIG. 1. A tobacco rod 22 can then be attached to one of the ends of each filter subassembly 26 to form a cigarette 20.

Figure 7:
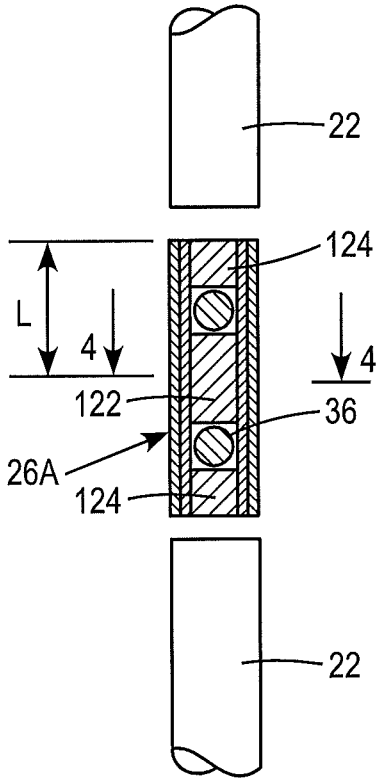
FIG. 7 is a longitudinal sectional view of a filter structure cut from the structure shown in FIG. 6 with cigarette rods being attached thereto.

Alternatively, the cuts made in FIG. 6 can be made only along cut lines 1-1 and 3-3 to form the filter structure 26A, i.e., a dual-filter structure, shown in FIG. 7, in which a center filter member 122 is twice as long as outer filter members 124. Tobacco rods 22 can be attached to respective ends of the dual filter structure 120. By then cutting the center filter member 122 in half along the cut line 4-4, two cigarettes will be formed.

Figure 8:
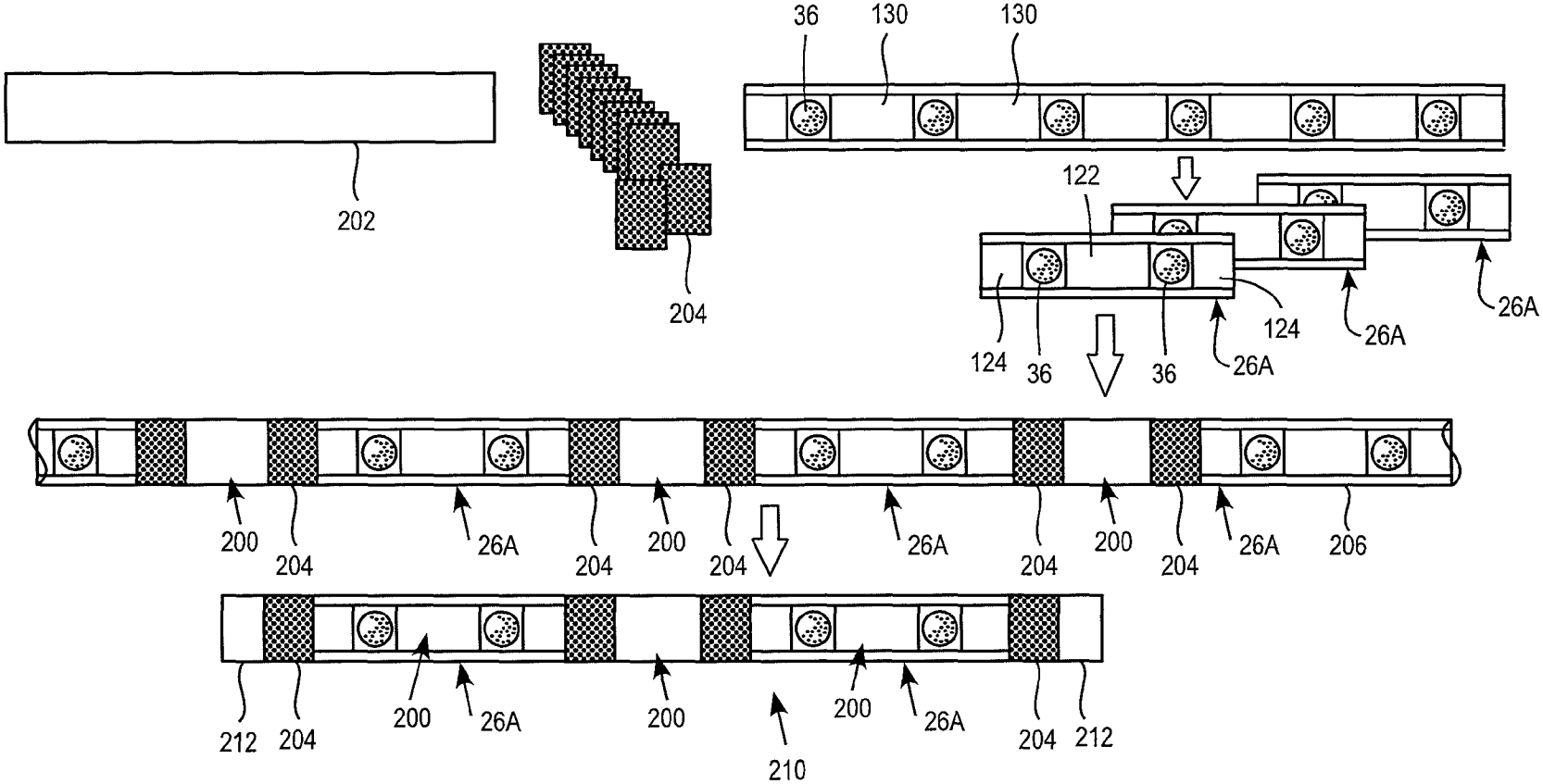
FIG. 8 is a schematic view of intermediate steps in the manufacture of cigarettes using the dual-filter structure of FIG. 7.

Another manufacturing technique involves arranging a series of the dual-filter structures 26A with additional members 200 provided therebetween (see FIG. 8). The additional absorbent members 200 are formed of cellulose acetate by cutting a filter rod 202 into the additional absorbent members 200, which may be enclosed within a plug wrap. In addition, a predetermined quantity of activated carbon 204 is provided between each of the additional absorbent members 200 and the adjacent dual-filter structures 26A. In this way, a quantity of activated carbon 204 is provided on both sides of each of the additional absorbent members 200. The series of additional absorbent members 200, the quantities of activated carbon 204, and the dual-filter structures 26A are enclosed within a plug wrap as conventionally known in the manufacture of multi-component cigarette filters.

In the preferred method of manufacture, every other one of the series of additional absorbent members is cut substantially midway between adjacent dual-filter structures 26A. The step of cutting produces a series of quad subassemblies 210. Each of the quad subassemblies 210 comprises one half of a first additional absorbent member 212, a first quantity of activated carbon 204, a first dual-filter structure 26A, a second quantity of activated carbon 204, a second additional absorbent member 200, a third quantity of activated carbon 204, a second dual-filter structure 26A', a fourth quantity of activated carbon 204, and one half of a third additional absorbent member 212.

Figure 9:
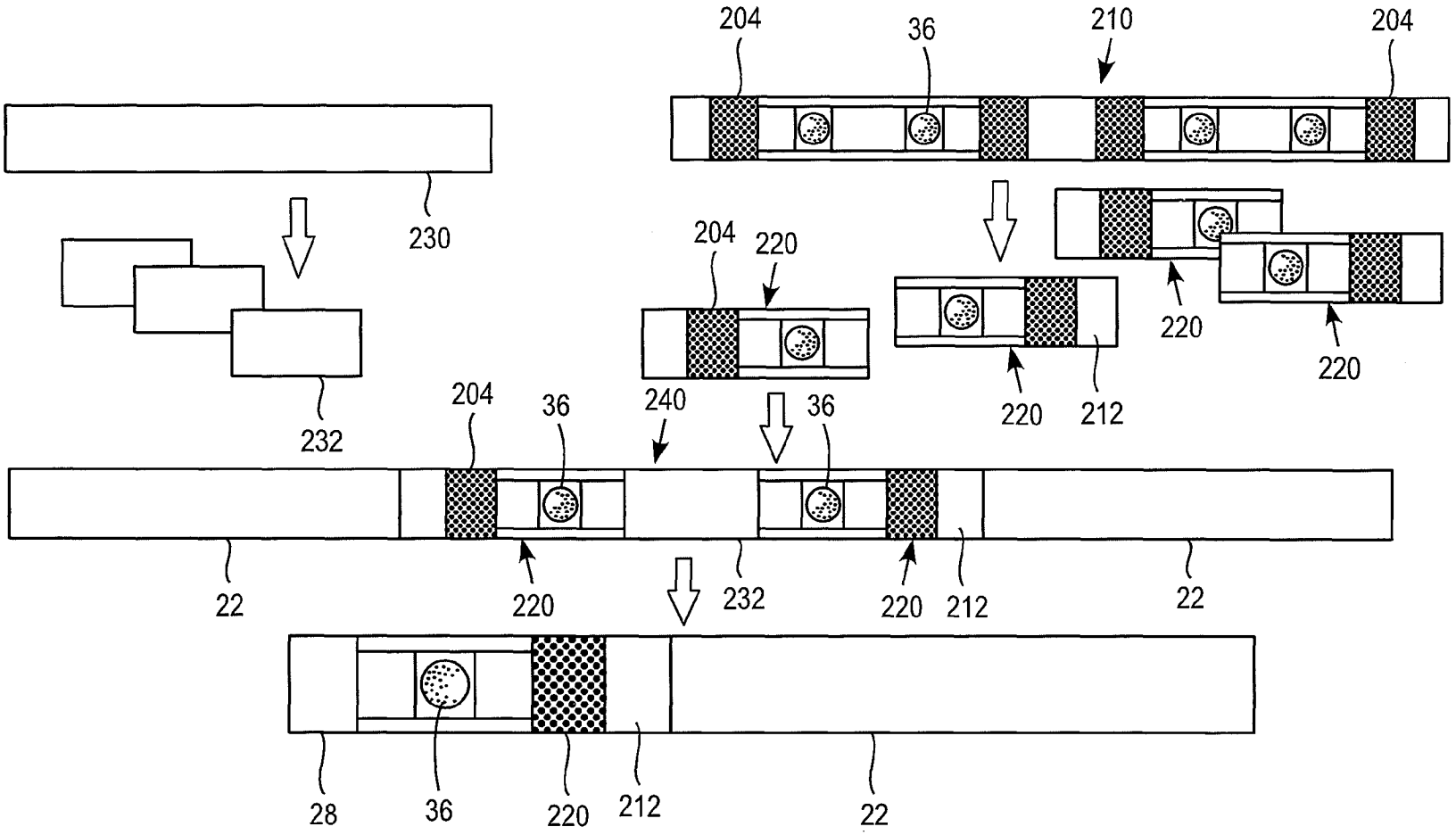
FIG. 9 is a schematic view of subsequent steps in manufacture of cigarettes using the dual-filter structure of FIG. 7.

With reference now to FIG. 9, in the preferred method of manufacture, each of the quad subassemblies 210 is cut into individual cigarette filter subassemblies 220. During manufacture, the first dual-filter structure 26A is cut midway between adjacent capsules, and the second dual-filter structure 26A' is cut midway between adjacent capsules to form the individual filter subassemblies 220. Subsequently, a cellulose filter rod 230 is cut into additional absorbent members 232, and one of the additional absorbent members 232 is arranged between two of the individual filter subassemblies 220. The individual filter subassemblies 220 are oriented so that the capsule 36 is located between the quantity of activated carbon 204 and the additional absorbent member 232. The two individual filter subassemblies 220 and the additional absorbent member 232 constitute a dual cigarette filter assembly 240.

Typically, at this time a tobacco rod 22 is attached to each end of the dual cigarette filter assembly 240 with the tobacco rods provided adjacent to the fourth absorbent members 212 of the cigarette filter subassembly 24 (see also FIG. 1). The tobacco rod and the filter assemblies may be provided with appropriate plug wraps and tipping wraps, as desired. Subsequently, the additional absorbent members 232 are cut in half to form the third absorbent members 28 of the cigarette filter assembly and to form two cigarettes, each with an individual cigarette filter assembly.

When the capsule 36 of the cigarette shown in FIG. 2 is broken by a smoker, the additive material is released from the capsule, but is isolated from the plug wrap 52 by the coated liner 42, 43. Mainstream smoke can flow from the tobacco rod through the second absorbent member 34 and then through the first absorbent member 32. Dilution air may flow through the steam-set cellulose acetate annular layer or over wrap. The two flows can be adjusted by adjusting the cellulose acetate filtration efficiency, through the use of dilution holes, etc. The capsule is suitable for use with cigarettes that include an activated carbon in the filter. The capsule may contain flavor components and may also contain components that facilitate selective filtration of the mainstream smoke and which are also released prior to smoking of the cigarette.

The steam-set cellulose acetate annular layer 42 and the first and second absorbent members 32, 34 can be adjusted in size, density and composition to achieve different levels of dilution, resistance to flow and delivery.

The orientation of the cigarette filter assembly 24 with respect to the tobacco rod 22 could be reversed so that the capsule 36 is provided between the tobacco rod 22 and the quantity of activated carbon 38 or a quantity of another sorbent. Depending upon the contents of the capsule 36, it may be preferable to have the capsule upstream rather than downstream of the sorbent.

If the capsule 36 is spherical, with a diameter of about 4 mm, the diameter of the cylindrical first and second absorbent members 32, 34 could be about 5 mm. In this way, air may flow around the capsule through a passageway provided by the outer cover 52 extending between the first and the second absorbent members 32, 34. The capsule preferably has a frangible wall which encapsulates the additive material. The frangible wall breaks to expose the additive material when the capsule is subjected to external force.

If desired, the capsule used to contain the additive material may be a two-part capsule, and may include a primary reservoir for additive material, where the additive material may be present in any form suitable for release from the capsule. By way of example, the primary reservoir may be completely or partially filled with a fluid additive (liquid or vapor) or additives and/or may contain: a porous compressive material such as a sponge saturated with additive(s), or non-adsorbing solids to decrease the space available for the additive(s) to protect them from possible premature rupture during the rigor of filter making. Preferably, walls of the one or more capsules protect the additive material from migration and allow for controlled release of the additive material.

In a two-part capsule, the two parts may seal and/or lock the additive material within a primary reservoir and prevent leakage of the additive material prior to intended release by mechanical action. The capsule may include two parts which lock or fit sealingly into place and then at least partially separate by application of an external force allowing for release of liquid or vapor from a contained additive material from within the two-part capsule. The seal formed by the two parts can be a mechanical seal. However, to improve seal quality a banded seal may be provided externally to the capsules at the point where the two capsule parts come together. The bands may be made out of gelatin, hydroxypropylmethyl (HPMC) or other suitable materials, preferably a material similar to the material used to form the capsules.

In order to release the contained additive material from the capsules, an external force, such as a mechanical action, is applied. One preferable method of applying the external force would be to have a user squeeze or exert an external force on a filter containing the capsule prior to or during the smoking of the cigarette. The squeezing action or application of external force preferably would break the capsule or at least partially deform a primary reservoir, which in turn would cause a displacement of mechanically locked or sealed in place internal components of the capsule. This displacement would then create one or more open spaces between internal components through which at least a portion of the additive material may be released from the capsule, e.g., liquid and/or vapor can be released from the capsule to modify the tobacco smoke passing through the filter. The acting force can be in a direction along or across the cigarette axis. Torsion may also be applied. An external device, such as a pinching device, a tube squeezing device, tweezers or any other device for applying torsion or compression forces, may also be used to concentrate the force at a prescribed filter location repeatedly.

In a two-part capsule, the two parts may physically separate rather than rupture upon being squeezed by the user, in order to provide for a relatively predictable result. However, rupture may also be used as rupturing the capsule would also result in creating open spaces through which at least a portion of the additive material may be released from the capsule.

In a unitary capsule, flavor solutions may be encapsulated within a singular-part, seamless capsule. Similarly, macrocapsules may be ruptured by applying force, wherein the macrocapsules are ruptured to release additive materials therein.

It is noted that the terms "capsules" or "macrocapsules" are intended to define large capsules, preferably equal to or larger than about 1 mm in diameter, preferably smaller than 1 mm.

A preferred cigarette would include a tobacco rod integrally attached to a filter, where the filter would include a filter subassembly having at least one capsule containing an additive material for modifying the characteristics of the cigarette smoke.

Preferably, a cigarette filter is arranged with the one or more capsules placed downstream from a sorbent material with filter material between the one or more capsules and the sorbent material or at the mouth end of the filter with one or more capsules placed between the mouth end of the filter or between the filter and the mouth end of the filter.

Also, a double capsule can be used herein. Preferably, a double capsule may be formed by a smaller capsule inside a larger one. These two capsules may contain materials or formulations that may or may not be compatible with each other. Double capsules, such as the DuoCap™ by Encap Drug Delivery of W. Lothian, Scotland can be used to hold the additive(s).

The quantity of activated carbon 38 provides a sorbent for the cigarette. The capsule 36 may be opened, e.g., ruptured, by a user of the cigarette squeezing the filter in the area of the capsule 36, causing deformation and/or breaking or opening of the capsule 36, thus releasing the additive and exposing the additive to mainstream smoke passing through the filter.

Preferably, the capsule 36 has a burst strength of about 0.5-0.8, 0.8-1.2, 1.2-1.6, 1.6-2.0 or 2.0-2.4 kilograms force (kgf).

Typically, the amount of additive used per cigarette may be extremely small since the additive is substantially sealed in the capsules during packaging and storing of the cigarette.

The viscosity of the additive may also be controlled to allow for controlled wicking of the additive into the absorbent members 32, 34 formed of cellulose acetate. Viscosity modifiers that could be used can include beeswax or other waxes for hydrophobic formulations and modified cellulosics, etc. for hydrophilic formulations.

The capsules may be of any size suitable for use in a cigarette, e.g., less than 2 mm, 2 to 3 mm, 3 to 4 mm, 4 to 5 mm or greater than 5 mm, and can vary in length depending on the length of the filter, e.g., less than 8 mm, 8-10 mm, 10-12 mm, or more than 12 mm. For traditional cigarettes, a capsule is preferably about 2 to 4 mm in diameter It is noted that the sorbent can also be incorporated into tow material for the filter. For example, activated carbon can be included within folds of a filter's tow material or within the bulk of the tow material, wherein the tow material forms a filter component of a cigarette.

To form generally spherical flavor capsules, a concentric nozzle can be used to co-extrude capsules having a flavor core and shell, the core being formed by a center passage of the concentric nozzle and the shell being formed by an outer passage of the concentric nozzle. The capsule formed at the end of the concentric nozzle can be dropped into a solution, where gelation can occur. By co-extruding a liquid center flavor core and a shell wall outer layer, a capsule can be formed with a liquid center and a gelled shell wall thus providing a structural containment for a liquid additive. Alternatively, single extrusion may also be used to produce capsules.

Preferably, the flavor capsules may be made containing flavor cores, which may be hydrophobic such as mint oil, menthol or other additives as mentioned above, and outer layers, such as shell walls composed of natural polysaccharides or of both natural and modified polysaccharides, but may also be a polymer or other shell wall materials. Preferred polysaccharides include pectin, alginate, carageenan, gums and agar. Preferred polymers include proteins like gelatin, modified cellulosics or synthetic polymers such as derivatives of polyacrylates.

Single extrusion to form capsules may also be possible. For example, a hydrophobic flavor can be dispersed within a solution of hydrophilic polysaccharide and the dispersion can be extruded through a single nozzle into a water-based cation solution suitable for cross-linking of the polysaccharide. By allowing separation of the hydrophobic flavor from the hydrophilic components of the system (the polysaccharide and the cation), a distinct hydrophobic core can be formed in a capsule.

For example, a single extrusion to form capsules can be accomplished by mixing a mixture of 1.1 g of a menthol/mint flavor formulation in a vial containing 5 ml LM20 (amidated low methoxy pectin with 20% methoxy content) pectin solution of 5% by weight in water. The vial can then be vigorously shaken to produce a dispersion of the flavor in the pectin solution. The dispersion can then be extruded through a syringe needle drop-wise into a calcium chloride solution under constant agitation. As a result, capsules of about 1-2 mm in size can be formed instantly as the drops impact the solution to crosslink the pectin by the calcium cations. The capsules can then be harvested and air dried. By using a Scanning Electron Microscopy (SEM) to investigate cross sections of capsules formed from the above exemplary methodology, it can be seen that the capsules can be formed with distinct core and shell geometries and with a non-uniform dispersion of the menthol/mint flavor formulation. Similarly, another mixture can also be formed containing 2.2 g of glycerol, 0.3 g of the menthol/mint flavor formulation and 1.5 g of the 5% LM20 pectin solution. Capsules from this mixture can similarly be formed by precipitation in calcium chloride solution and can result in a core-shell type geometry similar to the other capsules.

The thickness of the outer layer may be controlled through nozzle design, where the ratio and size of flavor core and the outer layer can be specifically chosen. Alternatively, the thickness of the outer layer may also be controlled through specific selection of an outer layer material and the solution used to gel the outer layer material, where the outer layer material and the solution may react quickly or slowly and therefore form thicker or thinner shell wall outer layers depending upon the speed of their reaction with the solution.

The flavor core, as mentioned above, is preferably a hydrophobic flavor, but may also be a hydrophilic flavor. If a hydrophilic flavor is desired, however, the outer layer material properties are preferably different from those used with hydrophobic flavors. Additionally, the flavor core can also be a dispersion of hydrophilic and hydrophobic components, where preferably the hydrophilic component contains cations which can affect an outer region of the outer layer. The thickness may also be controlled through overcoating the primary capsule by additional ionic gelation encapsulation or other means.

Additionally, additives may be used to control the toughness, thermal stability, capsule functionality, etc. For example, cross-linking additives and humectants can be used to control the toughness of the shell wall outer layers, while surfactants may be used to control hydrophilic/hydrophobic interfaces between the flavor core and the shell wall outer layer or between the shell wall outer layer and the solution.

While this disclosure has been described in detail with reference to specific embodiments, it will be apparent to one skilled in the art that various changes and modification may be made, and equivalents thereof employed, without departing from the scope of the appended claims.

The invention claimed is:

1. A method of manufacturing cigarette filter subassemblies comprising the steps of:

A. providing a filter member comprised of absorbent material surrounded by a cover, the filter member defining a longitudinal center axis;

B. passing a plunger axially through the absorbent material such that a generally pointed leading end of the plunger displaces the absorbent material radially outwardly, wherein the displaced absorbent material forms a liner along an inside surface of the cover and defines a hollow axial opening within the absorbent material;

C. axially inserting at least one absorbent member and at least one capsule into the hollow space, the capsule containing a releasable material for modifying characteristics of tobacco smoke during smoking; and D. providing a coating on an inner surface of the liner which is substantially impermeable to the releasable material in the at least one capsule prior to step C, wherein the coating is provided by applying to an outer cylindrical surface of the plunger, a binder material which is transferred to the inner surface of the liner as the liner is being formed.

2. The method according to claim 1, wherein the binder material is triacetin.

3. The method according to claim 1, wherein a series of absorbent members are inserted during step C, with at least one capsule disposed between successive absorbent members, to form an elongate filter structure which is cut to suitable length; each length containing at least one absorbent member and at least one capsule.

4. The method according to claim 3, wherein only one capsule is provided between successive absorbent members.

5. The method according to claim 1 wherein each capsule includes an outer shell comprising a flexible wall covered by a more brittle coating.

6. The method according to claim 1, wherein said at least one absorbent member is substantially cylindrical.

7. The method according to claim 1, wherein said at least one absorbent member is comprised of cellulose acetate.

8. The method according to claim 1, wherein said fluid material contained within the at least one capsule is a liquid or a vapor.

9. The method according to claim 3, further comprising the step of:

cutting every other absorbent member in said series of absorbent members at its axial midpoint to provide two dual-filter structures, each of said dual-filter structures comprising, in series, one half of a first absorbent member of twice the length of the first absorbent member, a first capsule, a second absorbent member, a second capsule, and one half of a third absorbent member, all disposed within said outer cover.

10. A method of forming a cigarette comprising the step of forming a cigarette subassembly according to claim 1, and attaching a cigarette rod to one end thereof.

11. A method of forming cigarettes comprising the step of forming a dual-filter structure according to claim 5 and attaching cigarette rods to respective ends thereof, and cutting the second absorbent member in half.

12. The method according to claim 5, further comprising the steps of:

providing a series of additional absorbent members, with one of said dual-filter structures being provided between adjacent additional absorbent members; and/or providing a quantity of activated carbon between each of said additional absorbent members and said adjacent dual-filter structure.

13. The method according to claim 7, further comprising the step of:

cutting every other one of said series of additional absorbent members substantially midway between adjacent dual-filter structures, said step of cutting producing quad subassemblies, each of said quad subassemblies comprising one half of a first additional absorbent member, a first quantity of activated carbon, a first dual-filter structure, a second quantity of activated carbon, a second additional absorbent member, a third quantity of activated carbon, a second dual-filter structure, a fourth quantity of activated carbon, and one half of a third additional absorbent member.

14. The method according to claim 8, further comprising the steps of:

cutting each of said dual-filter structures midway between adjacent capsules; and cutting each of said second additional absorbent members midway between adjacent dual-filter structures, whereby an individual cigarette filter subassembly is provided.

15. The method according to claim 9, further comprising the steps of:

providing an additional absorbent member between adjacent pairs of said individual cigarette filter subassemblies to form a dual cigarette filter assembly;

providing a tobacco rod generally adjacent each end of said dual cigarette filter assembly;

joining the tobacco rods to the dual cigarette filter assembly with tipping paper; and cutting said additional absorbent member substantially midway between said adjacent pairs of said individual cigarette filter subassemblies to form individual cigarettes.

* * * * *